United States Patent [19]

Turner

[11] Patent Number: 4,896,471

[45] Date of Patent: Jan. 30, 1990

[54] FIRE ROOF PANEL DOOR

[75] Inventor: Terry A. Turner, Princeville, Oreg.

[73] Assignee: Truline Manufacturing Inc., Redmond, Oreg.

[21] Appl. No.: 299,347

[22] Filed: Jan. 23, 1989

[51] Int. Cl.[4] ..... E04C 1/00

[52] U.S. Cl. ..... 52/455; 52/459; 52/813

[58] Field of Search ..... 52/455, 459, 785, 806, 52/809, 813, 311

[56] References Cited

U.S. PATENT DOCUMENTS

| | | | |
|---|---|---|---|
| 1,171,445 | 2/1916 | Larson | 52/455 |
| 1,174,401 | 3/1916 | Eckberg | 52/455 |
| 2,549,205 | 4/1951 | Katz et al. | 52/785 |
| 4,075,804 | 2/1978 | Zimmerman | 52/455 |
| 4,367,614 | 1/1983 | Warwick | 52/455 |
| 4,702,054 | 10/1987 | Turner | 52/455 |
| 4,811,538 | 3/1989 | Lehnert et al. | 52/455 |

FOREIGN PATENT DOCUMENTS

| | | | |
|---|---|---|---|
| 623856 | 2/1962 | Belgium | 52/459 |

*Primary Examiner*—Carl D. Friedman
*Assistant Examiner*—Caroline D. Dennison
*Attorney, Agent, or Firm*—Kolisch, Hartwell & Dickson

[57] ABSTRACT

A raised panel door wherein a support panel in the door has panel-simulating zones distributed over opposite faces. The support panel is made of a compacted, mineral-based, fire-retardant material, and special molding strips secure panel inserts in the panel-simulating zones to face overlays in the support panel.

4 Claims, 2 Drawing Sheets

FIRE ROOF PANEL DOOR

BACKGROUND AND SUMMARY OF THE INVENTION

This invention relates to a raised panel door, and more particularly, to a construction for such a door which enables the manufacture of doors having enhanced fire-resistant properties, whereby the doors may be employed in building installations where strict fire code regulations are applicable.

A conventional panel door comprises what are known as stiles and rails extending vertically and horizontally in the door. The rectangular spaces which are bounded by these stiles and rails are filled with panels, and these normally have tapered marginal edges which seat within grooves presented by the stiles and rails. A panel door of this description typically may be made of a decorative wood, such as oak, etc., and because of its esthetically pleasing appearance, is widely sold.

While a conventional door has a pleasing appearance, because of its material content and structure, the door suffers durability, security and safety problems that detract from its utility. Under the stress of normal usage and the passage of time, the stiles and rails tend to sag, warp and split, or otherwise separate from each other, with loosening of the panels which they encompass. The door provides a relatively poor barrier to the transmission of sound and offers little resistance to fire. More recently, doors have been proposed which feature what is referred to herein as a continuous core forming the midregion of the door, and overlays and/or panel inserts positioned over opposite sides of the door which impart to the door the appearance of a traditional panel door. Exemplary of such constructions are the constructions discussed in my prior U.S. Pat. Nos. 4,702,054 and 4,756,350.

In constructing a door intended to have a fire rating conforming to rigorous standards, as required presently in many constructions, such as offices, hotels, etc., the use of a core composed of a compacted mineral-based material would be advantageous because of such material's extremely high resistance to fire. It is not uncommon, for instance, for a door that is to meet rigorous specifications, that it withstand a temperature in the range of 1600° F. for an hour without burn through. However, another test to which a door may be subjected is known as a hose stream test, where the door after heat exposure is subjected to a stream of water projected thereat at, for example, 80 pounds per square inch through an inch line placed 20 feet from the door. While a compacted mineral-based mineral may have requisite fire-resistant properties, it has a crumbly consistency and tends to decrease in strength when subjected to a prolonged high temperature. As a consequence, the construction of a fire-resistant door using such a material, and where the door must meet severe standards, presents problems.

According to this invention, a raised panel-style door is contemplated, where overlays are applied to opposite sides of the door, in those regions which simulate the stiles and rails of the door, and these overlays are relied upon to provide strength to the door and as a means for securing an overlay or panel insert present in the door in a panel-simulating zone of the door.

More specifically, this invention contemplates the incorporation of molding strips in the door which, in cross section, have a lower level surface and spaced laterally therefrom, an upper level surface, with the body of a molding strip providing a bridge spanning these two surface levels. The molding strips are applied to the door with their lower level surfaces against an overlay or panel insert, as the case may be, in a panel-simulating zone of the door, and their upper level surfaces secured to the overlay which forms a face of the door.

In meeting more restrictive fire standards, the percentage of the face of the door which is taken up by the stile- and rail-simulating regions plays a part, since the stile- and rail-simulating regions generally are of greater thickness than portions of the door in a panel-simulating zone, which might be recessed inwardly into the door to produce the panel simulation, these recessed regions being located opposite each other in the door and cumulatively having the effect of reducing the thickness of the door where they appear. Following the invention, a fire-resistant material, such as a compacted mineral-based material, may be used essentially entirely throughout the width of the door in stile- and rail-simulating regions, with the molding strips contemplated providing a means for adhering overlays applied to the door in the stile- and rail-simulating regions.

BRIEF DESCRIPTION OF THE DRAWINGS

Various other objects and advantages will become more fully apparent from the following description, taken in conjunction with the accompanying drawings, wherein.

DETAILED DESCRIPTION OF A PREFERRED EMBODIMENT

Figure 1:
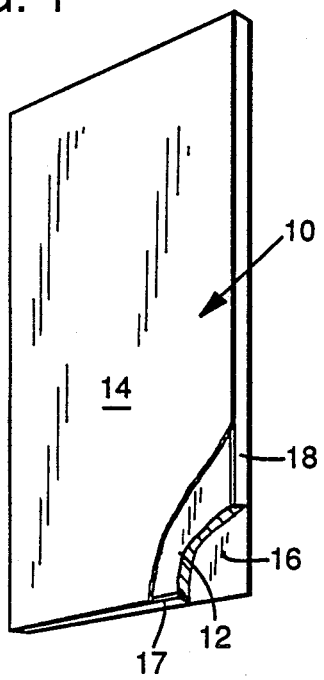
FIG. 1 illustrates a rectangular panel including a core with overlays applied to opposite sides of the core, such as might be employed in making the door of the invention.

Referring now to the drawings, and initially to FIG. 1, illustrated at 10 is a rectangular panel. The panel includes a rectangular core 12 of substantial width, and adhered to opposite faces, face overlays shown at 14 and 16. These may be of wood, preferably treated with fire-retardant material, or sheets of fire-retardant material with a simulated wood appearance. The core may be made of a compacted, mineral-based material, of a type that exhibits high resistance to fire and where the door must comply with strict regulations. By way of example, the core may have a width of approximately 2", whereas the face overlays may have a width of 1/16" or so. Bounding the panel and covering the core around the edges of the panel are edge strips 17, 18.

Figure 2:
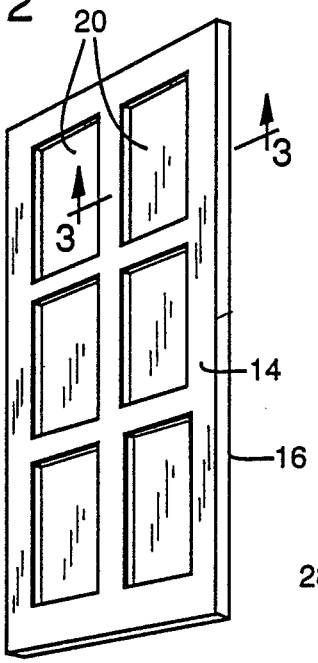
FIG. 2 illustrates the rectangular panel of FIG. 1 with plural rectangular recessed regions having been formed in a side of the panel in FIG. 1.
Figure 3:
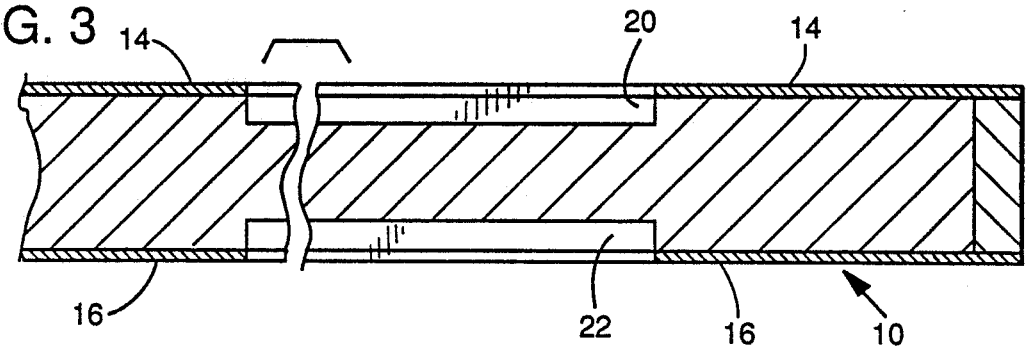
FIG. 3 is a cross-sectional view, on a somewhat enlarged scale, taken generally along the line 3—3 in FIG. 2, illustrating the presence of rectangular recessed regions on each of opposite sides of the panel.

In the manufacture of a door, rectangular recessed regions may be formed by cutting away material from the panel to produce such regions Such recessed regions, as such would typically appear on one side of the door, are shown in FIG. 2 at 20. In the usual panel door, the recessed regions on one side of a door would be aligned and opposite like sized recessed regions on the opposite side of the door. Thus, as shown in FIG. 3, the recessed region 20 on one side is aligned with recessed region 22 on the opposite side.

In the product so produced, the core material extends continuously throughout the panel. With recessed regions of, for example, ⅝' depth, and with a thickness of the core of 2", the core material where such extends between oppositely disposed recessed regions has a width of ¾".

Figure 4:
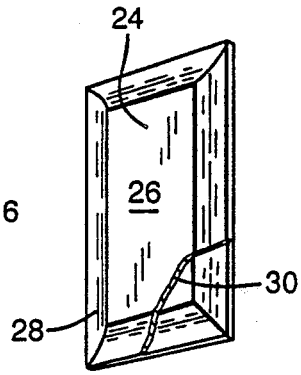
FIG. 4 is a view illustrating a panel insert, such as might be employed in the invention.

A panel insert, such as the one shown at 24 in FIG. 4, may be placed in each rectangular recessed region. The panel insert is rectangular in outline, with the outer dimensions of the panel insert being only slightly less than the outer dimensions of a rectangular recess, whereby the insert may be fitted with slight clearance into the recess. The panel insert has a rectangular raised region at its center, as designated at 26, and from this raised region slopes down on all four sides to margins, such as shown at 28, having a thickness reduced from that of a thickness of the raised region 26. To accentuate the appearance of a panel in a door, the center raised region might have a thickness somewhat exceeding the ⅝" depth of the rectangular recess, for example, a ¾" thickness. In comparison, outer extremities of margins 28 of the panel insert might typically have a thickness of ⅛".

A panel insert might be made of a fire-retardant material, such as a particle board material, including borate compounds or other compounds imparting fire resistance to the panel insert. The adhesive employed in bonding the particles in the material, as in the usual fire-retardant panel, by way of example, might comprise a cross-linked polyvinyl acetate. Typically, a panel insert would have an overlay extending thereover covering the center raised region of the insert, as well as the margins of the insert. Such overlay is shown at 30. The overlay may be like the overlays 14, 16 earlier described.

To secure the panel inserts in place, a suitable adhesive with fire-retardant properties may be applied over the inner surfaces of the recesses, which bonds the inserts in place. Additionally, molding strips are provided, such as those shown at 32, extending along each marginal expanse of the panel insert, with these molding strips covering the core where such is exposed at the edge of a rectangular recess, for instance, region 34 shown in FIG. 5, and also serving, by reason of abutment of one surface in the molding strip with the margin of an insert and abutment of another surface in the strip with the outer overlay on the panel, to anchor the insert with means secured through the overlay to the core.

Figure 5:
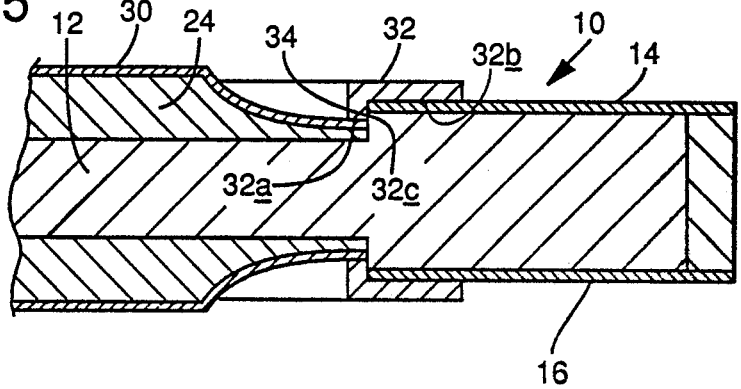
FIG. 5 is a cross-sectional view illustrating the door after its completion, with the placement of panel inserts into the rectangular recessed regions and the further placement of molding strips as contemplated.
Figure 7:
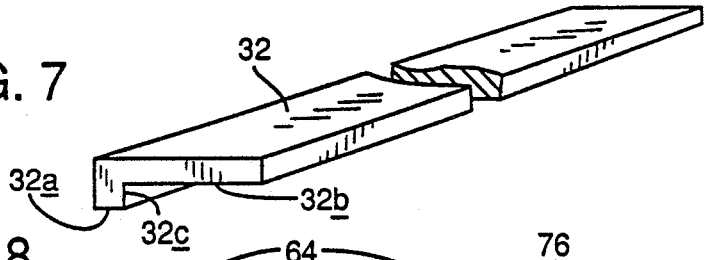
FIG. 7 is a perspective view of portions of a molding strip.

More specifically, and referring to FIG. 7 which shows a strip, the molding strip is approximately L-shaped in cross section and has a lower level surface **32*a* and disposed laterally of this surface, an upper level surface 32*b*. These two levels of surfaces are spanned or bridged by the body of the strip. With a molding strip in place, its lower level surface 32*a*, as shown in FIG. 5, is against the overlay of the panel insert. Surface 32*c* which joins the lower and upper level surfaces is against what otherwise might be the exposed margin of the core. Upper level surface 32*b* lies snugly against and is secured as by an adhesive to overlay, such as overlay 14**, which extends over the core in regions spaced outwardly from the rectangular recess.

Figure 6:
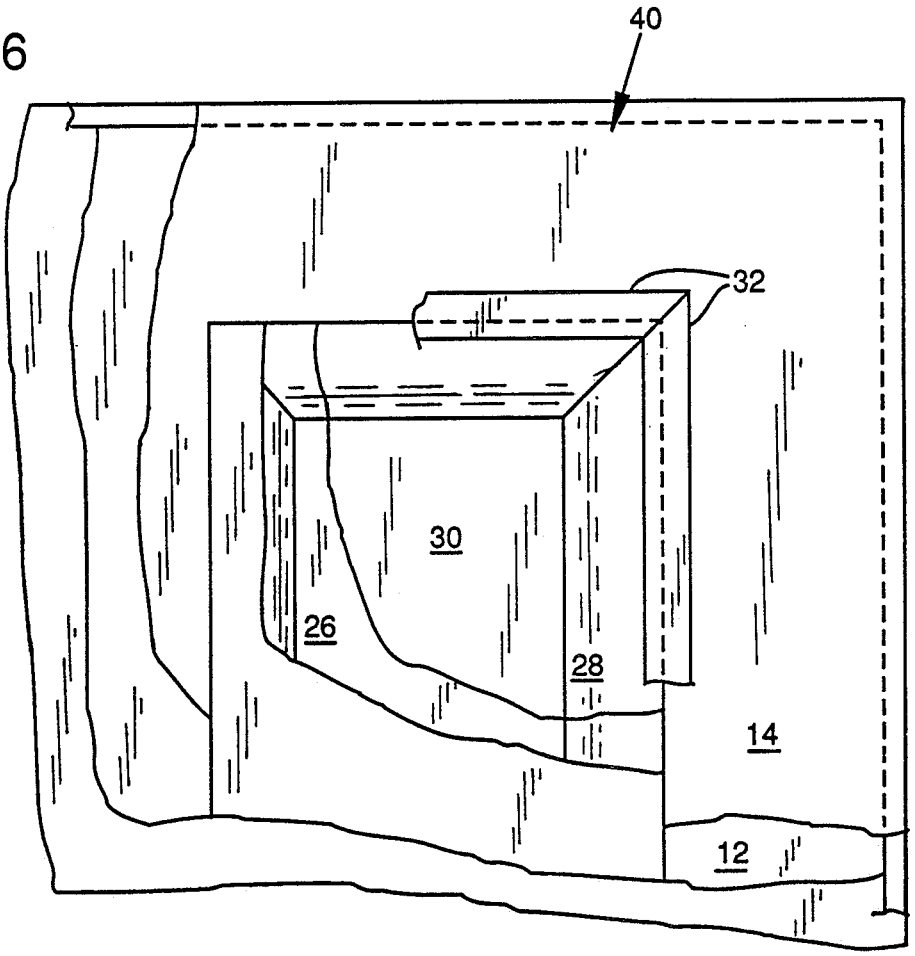
FIG. 6 is an illustration of a portion of a face of the door after completion.

A door so made, and when completed, will appear as shown by the door 40 in FIG. 6. The core extends continuously in the door. The door has panel-simulating zones distributed over each of its opposite faces. In a panel-simulating zone, the core is covered by an insert. The insert present is covered by an overlay, with this overlay extending over the raised center region as well as margins of the insert. In regions outwardly from a panel-simulating zone, the core has greater thickness and is covered by overlays 14, 16. Because of the reduced thickness of the margins of a panel insert, such lie well below the level of the core surfaces, so that a channel is provided which extends in a rectangular course and which forms the perimeter of each panel-simulating zone. The molding strips, by reason of the bonding of their upper level surfaces to the overlay which extends over face regions of the door, provide secure anchoring for the inserts and introduce strength to the door, even after extended exposure to heat on one side of the door, typical of the conditions the door is exposed to when subjected to a fire rating test.

Figure 8:
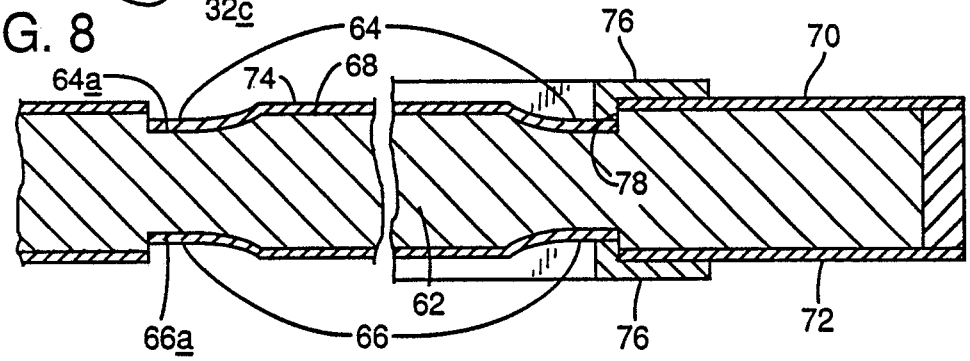
FIG. 8 is a cross-sectional view illustrating a modified form of door construction.

FIG. 8 illustrates a modification of a door according to the invention. In this instance, core 62 of fire-retardant material has channels extending in a rectangular course prepared therein on each of its opposite sides, as exemplified by channel 64 prepared on one side of the door and channel 66 prepared on the opposite side. Each channel encompasses a rectangular raised region of the core, such as the one shown at 68. The channels are bottomed by bottom surfaces, as shown at **64*a* and 66*a*, recessed inwardly from face regions of the core disposed laterally outwardly of the channels. These face regions of the core have overlays applied thereto, as indicated at 70, 72, and overlays are applied to cover a panel-simulating zone, as exemplified by overlay 74, which covers the raised center region of the zone, as well as the surfaces bottoming the channel which encompass the raised region. Molding strips, shown at 76, are applied, as in the case of the first embodiment of the invention. These have body portions bridging upper and lower levels of surfaces. Lower surface levels of the strips abut overlay 74, upper surface levels abut overlay 70, and the molding strips also cover regions 78** of the core panel which otherwise would be exposed.

Following the invention, overlays which are present, and in the manufacture of a door intended to resemble a wooden panel door, may be overlays prepared from wood veneers, preferably processed to have fire-retardant properties. Overlays could also be utilized which are a composite of a wood veneer together with a lamina of another material, such other material being selected, for instance, by reason of increased fire-resistant properties. Alternatively, an overlay could be prepared from a nonwood, fire-retardant material surfaced to have the appearance desired.

As should be apparent, the molding strip construction utilized provides back-up strength in the door in regions of the door which are most vulnerable to damage under severe testing procedures. Securement of these molding strips is to face overlay regions, these regions being separated by portions of the core having maximum thickness.

While embodiments of the invention have been described, it should be obvious that other modifications and variations are possible.

It is claimed and desired to secure by Letters Patent:

1. A fire-resistant raised panel door comprising:

a support panel, one or more rectangular panel-simulating regions formed on each of opposite sides of the support panel, with each panelsimulating region on one side of the support panel being opposite and aligned with an opposed panel-simulating region on the opposite side of the support panel, the support panel on each side having face regions extending about and disposed laterally outwardly of each panel-simulating region, a face overlay secured to the face regions of the support panel on each side of the support panel, each panel-simulating region including a channel extending in a rectangular course forming the perimeter of the region, the channel being bottomed by bottom surfaces recessed inwardly from the face regions of the support panel and the channel encompassing a rectangular raised expanse, an overlay for each panel-simulating region covering the rectangular raised expanse of the panel-simulating region and further covering the bottom surfaces of the channel that encompasses the raised expanse of the region, and molding strips extending in the course of each channel, the molding strips, when viewed in cross section, each having on the interior thereof a lower level surface and an upper level surface and a body of the molding strip providing a bridge spanning the two levels of the molding strip, the molding strips being mounted with their lower level surfaces against the overlays which cover the bottom surfaces of the channel and with their upper level surfaces affixed against the face overlays.

2. The door of claim 1 wherein the support panel is fire-resistant, and made of a compacted mineral-based material throughout the entire width of the panel where the panel extends between face overlays on opposite sides of the panel, the panel extending as a continuous web of compacted mineral-based material between opposed panel-simulating regions.

3. The door of claim 2, wherein the overlays for the panel-simulating regions are of a fire-resistant material.

4. A raised panel door comprising:

a fire-resistant rectangular panel core composed of a compacted mineral-based material, at least one rectangular recessed region in one side of said panel core and at least one rectangular recessed region in the opposite side of said panel core, the recessed regions being of like size and aligned with each other, the panel core having face regions disposed laterally of said recessed regions, and face overlays secured to face regions of the panel core, a rectangular panel insert composed of fire-resistant material inlaid within each recessed region, each insert being bounded by margins extending about the perimeter of the insert and said margins having a reduced thickness in comparison to the thickness of the center of the panel insert, and molding strips for each panel insert having, when viewed in cross section and on the interior thereof, a lower level surface and an upper level surface with a body of the strip providing a bridge spanning the two level surfaces, the molding strips being mounted with their lower level surfaces overlying the margins of the panel inserts and with their upper level surfaces secured to and overlying the face overlays.

* * * * *